US007364458B1

(12) United States Patent
Ju

(10) Patent No.: US 7,364,458 B1
(45) Date of Patent: Apr. 29, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/641,794

(22) Filed: Dec. 20, 2006

(51) Int. Cl.
*H01R 13/52* (2006.01)

(52) U.S. Cl. ..... 439/524; 439/88; 439/607; 439/931

(58) Field of Classification Search ..... 439/86, 439/88, 524, 607, 609, 931
See application file for complete search history.

(56) References Cited

U.S. PATENT DOCUMENTS 4,598,961 A * 7/1986 Cohen ..... 439/63
5,509,823 A * 4/1996 Harting et al. ..... 439/607
5,936,581 A * 8/1999 Roshitsh et al. ..... 343/702
6,053,744 A * 4/2000 Gray et al. ..... 439/63
6,473,045 B1 * 10/2002 Duquerroy et al. ..... 343/702
6,488,533 B1 * 12/2002 Thompson et al. ..... 439/509
6,524,120 B2 * 2/2003 Zhao ..... 439/95
7,011,556 B2 * 3/2006 Miyazawa et al. ..... 439/886
2006/0174481 A1 * 8/2006 Ju ..... 29/874
2006/0188580 A1 * 8/2006 Sacks ..... 424/489

* cited by examiner

*Primary Examiner*—James Harvey
(74) *Attorney, Agent, or Firm*—Rosenberg, Klein & Lee

(57) ABSTRACT

An electrical connector includes an insulated body and a plurality of conductive terminals. A plurality of terminals accommodating holes disposed inside the insulated body for receiving the conductive terminals therein. There is a metal shielding layer arranged on the surface of the insulated body. Compared with technology available now, the electrical connector according to the present invention includes the metal shielding layer disposed on the insulated body so as to avoid electromagnetic interference and static interference, and such shielding layer having a simpler structure, smaller volume at lower cost.

9 Claims, 1 Drawing Sheet

ELECTRICAL CONNECTOR

BACKGROUND OF THE INVENTION

The present invention relates to an electrical connector, especially to an electrical connector having shielding effect.

Due to fast development of computer science and digital technology, a lot of electrical connectors with high-density terminals and fast transmission speed have been developed. Especially in computer industry, a plurality of electrical connectors for transmission of large amount of high-speed data is disposed on a circuit board. However, along with more connectors, the distance between the two contiguous connectors is getting closer while the signal transmission frequency is getting higher. Here a problem has arisen in developing high-density electrical connector—noise interference during data transmission process. Generally there are two kinds of interference: one is electromagnetic interference and the other is static interference. The most common way to avoid electromagnetic interference is by adding a metal shielding housing on the electrical connector. The way to prevent static is by grounding of the above metal shielding housing for dissipation of any accumulated charge. Refer to U.S. Pat. No. 6,010,367, a metal shielding formed by a metal housing is disclosed. The connector includes a shielding device consisting of a first shell and a second shell for providing excellent shielding effect. Yet due to certain thickness and volume of the metal housing, such shielding device occupies quite a lot of space on the circuit board and somewhat increases its weight. The trend for IT technology now is with higher density of electronic components, smaller volume, and lighter weight. Thus the disposition of metal shielding housing can't meet such requirements of the minimization of electronic components. Moreover, such kind of design has higher cost.

Therefore, there is a need to develop a new electrical connector.

SUMMARY OF THE INVENTION

Therefore it is a primary object of the present invention to provide a compact electrical connector with better shielding effect, smaller space and lighter weight. In order to achieve object, the present invention provides an electrical connector for connecting corresponding electronic components on a circuit board. The electrical connector consists of an insulated body, a plurality of terminals received inside the insulated body, and a shielding layer formed by continuous metal granules on surface of the electrical connector.

Compared with technology available now, the present invention uses the continuous metal granules on surface of the electrical connector to prevent interference and such kind of metal shielding not only saves space, but also reduces weight of the electrical connector. Moreover, the manufacturing cost is reduced and better shielding effect is achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 1:
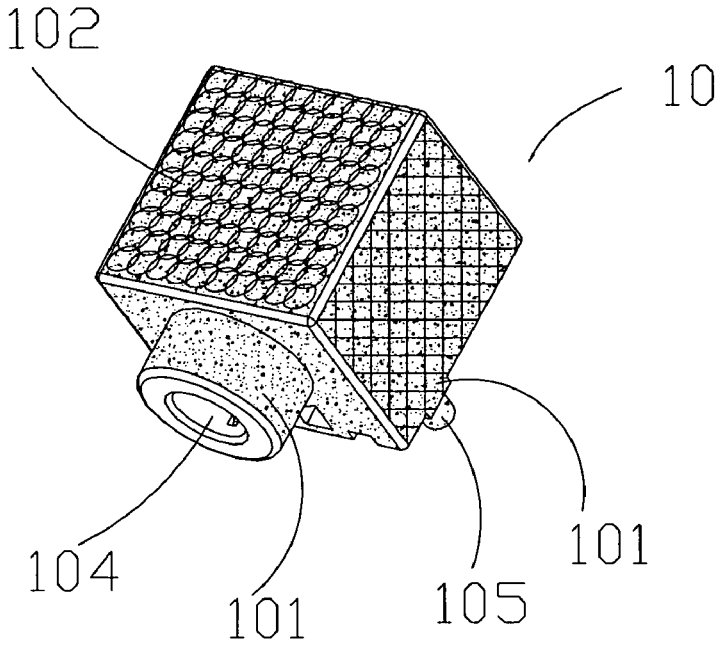
FIG. 1 is a perspective view of an electrical connector disposed with a shielding layer according to the present invention.
Figure 2:
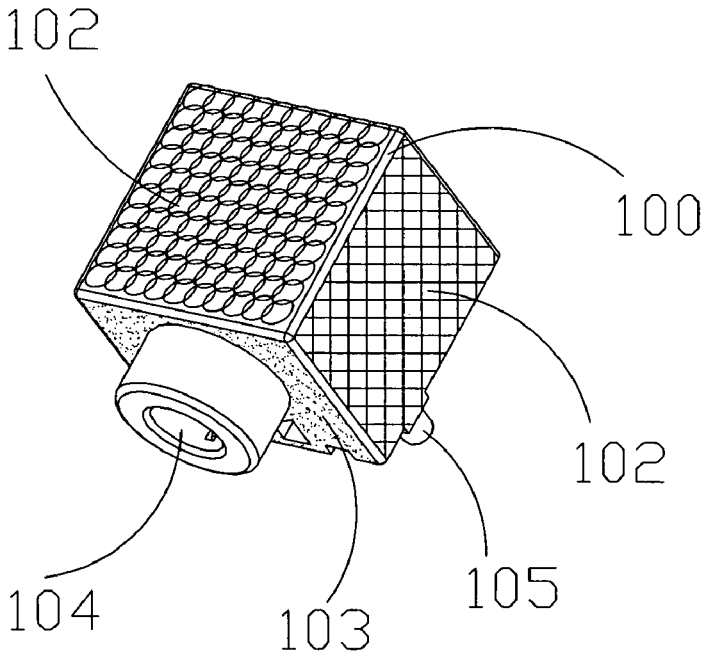
FIG. 2 is a perspective view of an electrical connector in FIG. 1 without a shielding layer according to the present invention.

Refer to FIG. 1 & FIG. 2, an electrical connector 10 for connecting corresponding electronic components on circuit boards (not shown in figure) according to the present invention consists of an insulated body 100, a plurality of conductive terminals (not shown in figure) mounted inside the insulated body 100, and a shielding layer 101 disposed on surface of the electrical connector 10. The shielding layer 101 is a thin layer having continuous metal granules formed by painting conductive paint on surface of the insulated body 100.

A plurality of recesses 102 that changes distribution of metal granules inside conductive paint is arranged on surface of the insulated body 100 in various ways such as interlaced arrangement, intercross, or perpendicular with each other. The recess 102 can be a concave on rough surface or notch groove 103 so as to avoid electrically disconnection in part of the area caused by over smooth of the surface of the insulated body 100, while painting the conductive paint on surface of the insulated body 100 to form the shielding layer 101. The recess 102 and the concave on rough surface allow more conductive paint coated thereon so that electrical connections on various areas of the surface can be improved by the recess 102 and the concave. Moreover, a receiving hole 104 for receiving corresponding electrical component is disposed on front surface of the electrical connector 10. There is no shielding layer inside the receiving hole 104 so as to avoid short caused by accidental contact between two points.

A projecting part 105 for connecting with the circuit board is disposed on the electrical connector 10. And a shielding layer 101 for electrically connecting with ground of the circuit board is also arranged on the projecting part 105. Another way for shielding is to dispose a metal part (not shown in figure) on one side of the electrical connector 10. One end of the metal part is electrically connected with the shielding layer 101 on surface of the electrical connector 10 while the other end of the metal part is soldered on the circuit board so as to electrically connect with the ground of the circuit board for shielding.

In summary, the present invention provides a shielding layer having continuous metal granules and formed by coating conductive paint on surface of the insulated body 100. Compared with metal shield, the present invention saves space, reduces the cost, makes operation and processing more convenient and provides better shielding effect. It is feasible to apply a layer of metal coating on the shielding layer of the present invention by physical vapor deposition or chemical vapor deposition to protect the shielding membrane and to achieve better shielding effect.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An electrical connector for electrically connecting corresponding electrical components on a circuit board, comprising:

an insulated body;

a plurality of conductive terminals mounted inside the insulated body;

a shielding layer having metal granules contained therein disposed on at least one outer surface of the electrical connector; and a plurality of recesses arranged on the insulated body of the electrical connector for changing a distribution of metal granules thereat.

2. The electrical connector as claimed in claim 1, wherein the shielding layer is a membrane made from conductive paint.

3. The electrical connector as claimed in claim 1, wherein a receiving hole for receiving a corresponding electrical component is disposed on the electrical connector while the receiving hole having no shielding layer arranged therein.

4. The electrical connector as claimed in claim 1, wherein the electrical connector defines a rough surface, the recess is a concave on the rough surface.

5. The electrical connector as claimed in claim 1, wherein the recesses are in an interlaced arrangement.

6. The electrical connector as claimed in claim 1, wherein the recesses are intercrossed.

7. The electrical connector as claimed in claim 1, wherein the recesses are arranged in perpendicular to each other.

8. The electrical connector as claimed in claim 1, wherein a layer of metal coating is deposited on the shielding layer.

9. The electrical connector as claimed in claim 1, wherein a projecting part that electrically connects with the circuit board is disposed on the electrical connector and the projecting part is disposed with a shielding layer.

* * * * *